166-65 SR

M721B XR 4,364,587

United States Patent [19]

Samford

[11] 4,364,587

[45] Dec. 21, 1982

[54] SAFETY JOINT

[76] Inventor: Travis L. Samford, 6110 Elmgrove, Spring, Tex. 77379

[21] Appl. No.: 209,686

[22] Filed: Nov. 24, 1980

Related U.S. Application Data

[63] Continuation-in-part of Ser. No. 69,639, Aug. 27, 1979, abandoned.

[51] Int. Cl.[3] ..... F16L 37/08

[52] U.S. Cl. ..... 285/3; 285/18; 285/39; 285/35; 285/85; 285/93; 285/332; 285/334; 285/DIG. 21; 285/DIG. 23; 166/65 R; 166/250; 166/377

[58] Field of Search ..... 285/33, 34, 35, 85, 285/86, 91, 92, 333, 334, DIG. 23, 18, 319, DIG. 21, 355, 119, 390, 332, 39, 315, 3, 4, 93, 1; 166/24 L, 65 R, 250, 377; 175/57, 65, 320; 403/315, 316, 317, 320

[56] References Cited

U.S. PATENT DOCUMENTS

| | | | |
|---|---|---|---|
| 2,244,124 | 6/1941 | Shemeley | 285/84 X |
| 2,532,686 | 12/1950 | Ware | 285/2 |
| 2,737,248 | 3/1956 | Baker | 285/34 |
| 2,827,312 | 3/1958 | Spencer | 285/18 |
| 2,849,245 | 8/1958 | Baker | 285/390 |
| 3,071,188 | 1/1963 | Raulins | 285/34 X |
| 3,359,013 | 12/1967 | Knox et al. | 285/334 X |
| 3,842,914 | 10/1974 | Mott | 285/34 X |
| 3,966,236 | 6/1976 | Vann | 285/315 X |
| 4,009,893 | 3/1977 | Schutton et al. | 285/334 X |
| 4,040,649 | 8/1977 | Blackwell | 285/3 |
| 4,066,282 | 1/1978 | Vann | 285/314 X |
| 4,074,912 | 2/1978 | Bilderbeck | 285/86 |
| 4,161,216 | 7/1979 | Amancharia | 285/18 X |
| 4,220,206 | 9/1980 | Van Winkle | 285/3 |
| 4,248,307 | 2/1981 | Silberman et al. | 285/3 X |

*Primary Examiner*—Dave W. Arola
*Attorney, Agent, or Firm*—Gunn, Lee & Jackson

[57] ABSTRACT

For use in a drilling string including drill collars, a safety joint which enables the string of drill pipe to be unthreaded from the drill collars at the safety joint is disclosed. A safety joint utilizes a collet telescoped within and threaded to an outer tubular member connected in the drill string. They are held together by a releasable lock pin which is inserted and retracted to thereby enable the drill string to be separated at the safety joint so that remedial steps can be taken to free the remainder of the drill string. The safety joint is also capable of being actuated mechanically under control from the surface.

Particular valve and signal receivers are disclosed herein including frequency responsive structural components which vibrate on being inflicted with a particular ultrasonic signal. The vibratory components oscillate and thereby initiate leakage of hydraulic oil from a pin locking system. Several alternate forms are disclosed.

25 Claims, 17 Drawing Figures

Fig. 6A
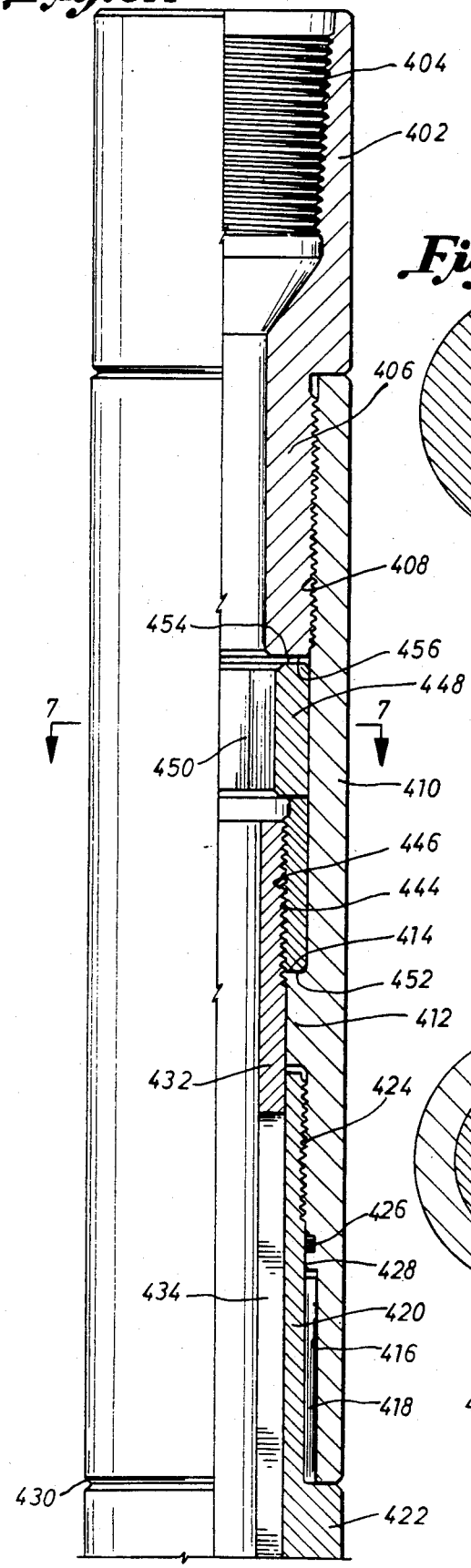
Fig. 8
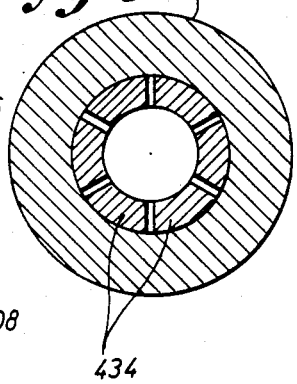
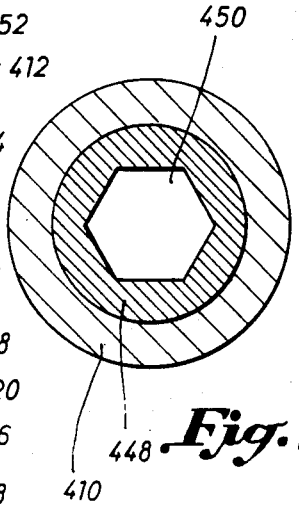
Fig. 7
Fig. 6B
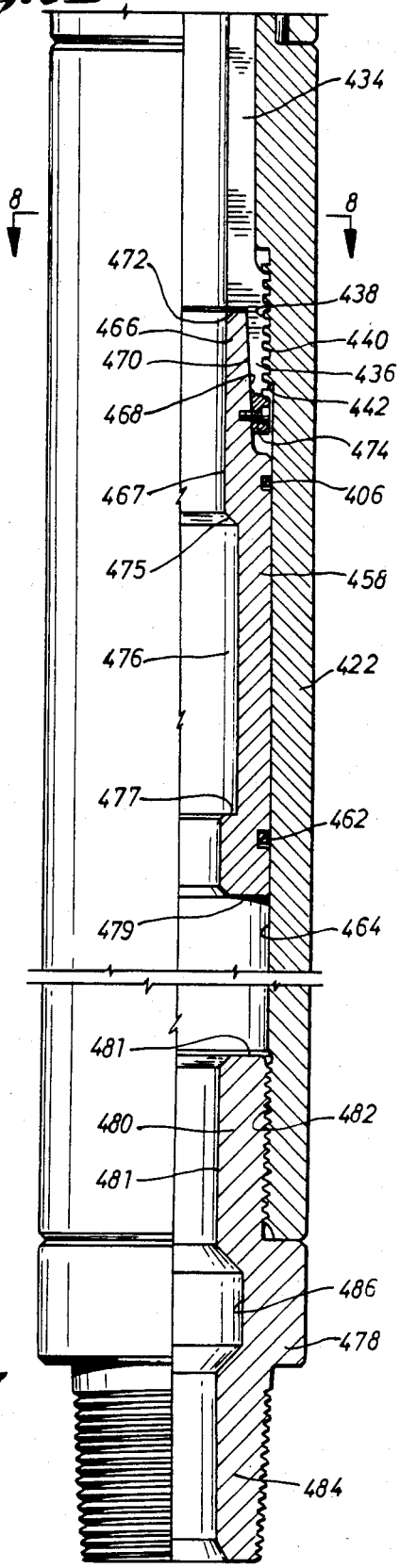

SAFETY JOINT

This application is a continuation-in-part of application Ser. No. 069,639, filed Aug. 27, 1979 by Travis L. Samford, et al and entitled IMPROVED SAFETY JOINT, now abandoned.

BACKGROUND OF THE DISCLOSURE

The drill string utilized in drilling a well typically includes a drill bit at the bottom, a set of drill collars above it which are heavy wall pipe to impart direction control in drilling the well and a string of drill pipe which extends to the surface. The drill pipe is rotated, and, of course, the rotation is imparted to the full length of the drill string. Sometimes, a hole drifts slightly and carries the drill string into contact with the side of the hole. Sticking can occur, for instance, when the drill string forms or cuts a key seat, and it can also be occasioned by differential pressure sticking. Without regard to the cause, sticking is a common problem. Sticking is a problem which often requires in-place disassembly of the drill string. It may be necessary, as an example, to retrieve the drill pipe, but leave the drill collars and drill bit in the hole. They are left for a subsequent fishing trip. While sticking can typically occur at any place along the drill string, but ordinarily occurs at the drill collars, remedial steps typically begin by unthreading the drill pipe from the drill collars.

This is ordinarily accomplished through the use of a safety joint. A drill string is threaded by rotation to the right so that drilling via rotation in the same direction continually tightens the threaded connection from joint to joint. Reverse rotation occurs, but is relatively rare. The present invention is a safety joint which enables disconnection without running the risk of accidental unthreading at some other threaded connection in the drill string. In safety joints where rotation in the reverse direction is required to unthread the drill string, the risk of unintended unthreading at some other joint is quite great. Occasionally, it is necessary to rotate to the left, and accidental unthreading occurs from time to time as a result of rotation to the left. This failure of prior art safety joints has been overcome by the present disclosure.

BRIEF DESCRIPTION OF THE DISCLOSED APPARATUS

The apparatus disclosed herein is a safety joint which enables the drill pipe to be freed from the drill collars only on controlled release. This is advantageous in that accidental disconnection is avoided. Unthreading at any other joint is also avoided. It will be appreciated that a fishing job of some difficulty and expense may be required to retrieve the drill collars or other portions of the drill string left downhole after improper disconnection.

While other safety joints are known, this structure is a safety joint which is triggered into operation from the surface and, therefore, accomplishes quick and ready release only when triggered. Triggering is under control at the surface, and, therefore, accidental release at the safety joint is prevented.

One advantage of the present apparatus is that release of the drill collars at the safety joint is triggered by the positive transmission of signals down the drill pipe and the mud in it. The drill pipe is fabricated from high quality steel and is, therefore, able to conduct an ultrasonic signal. The many joints which comprise the drill string are threaded together and constitute a solid transmission path for ultrasonic signals. The present apparatus is particularly able to transmit a signal down the drill string to the safety joint whereupon release is enabled, thereafter permitting the driller to lift up on the drill string and to pull the drill pipe free at the safety joint. The drill collar portion of the stuck drill string is left in the well, and retrieval of the stuck portion can be undertaken later in a fishing job. One significant advantage is that the safety joint serves its intended purpose which is triggered release of the drill string above the safety joint.

With the foregoing in mind, the apparatus is briefly summarized as a safety joint formed of an outer tubular member threaded to an inner tubular member terminating in a set of collets having threads thereon. The collets define a set of fingers with adjacent slots or grooves. They are able to deflect on upward pull, the collets being threaded to the outer tubular member by a thread which enables the two members to be pulled apart.

A lock pin holds the collet fingers in threaded engagement. The lock pin is retracted in response to an ultrasonic signal transmitted down the drill string. When the lock pin is retracted, the collet fingers are freed for deflection, and they deflect as an upward pull is taken.

The present disclosure is directed to particular improvements in a safety joint release system. It defines a release system which is responsive either to a single frequency or to two frequencies to provide a safety or interlock system. The safety joint of the present invention is triggered in operation by transmitting an ultrasonic signal down the drill string. In the chance that vibrations which arise from routine operation with the drill string might create a false or bogus signal, this might trigger untimely operation of a release or lock mechanism in the safety joint. While it is highly improbable, dependent on the choice of frequencies and amplitudes for the ultrasonic signal, through the use of two ultrasonic signals which have a nonharmonic relationship, it is possible to avoid this problem completely. In alternate embodiments of the present invention, such an alternate system is provided.

In the alternate embodiments, certain advantages are thus obtained as, for instance, the ability to respond to two ultrasonic signals. Where two signals are used, they are selected so that they have no harmonic relationship, and, further, they are selected so that they are quite different from the domiant modes of vibration experienced in the drill string. The vibration modes which are normally encountered in the drill string are reasonably well known.

The apparatus further includes a safety or lock pin which prevents accidental disengagement of the safety joint. The lock pin is supported by a closed hydraulic system. Fluid is drained from the hydraulic system on transmission of an ultrasonic signal along the drill string. It is transmitted from the wellhead to a receiver at the safety joint. The receiver is an ultrasonic listening device of mechanical construction which has a very sharp notch filter response. It has a filter with a high Q which is, therefore, able to reject unwanted frequencies arising as a result of vibration which occurs in the drill string during its customary use.

BRIEF DESCRIPTION OF THE DRAWINGS

FIG. 6A is a sectional view of the upper portion of a mechanically releasable safety joint manufactured in accordance with this invention.

FIG. 6B is a sectional view of the lower portion of the safety joint shown in FIG. 6A.

FIG. 7 is a sectional view taken along line 7—7 of FIG. 6A.

FIG. 8 is a sectional view taken along line 8—8 of FIG. 6B.

DETAILED DESCRIPTION OF THE ILLUSTRATED EMBODIMENT

Figure 1:
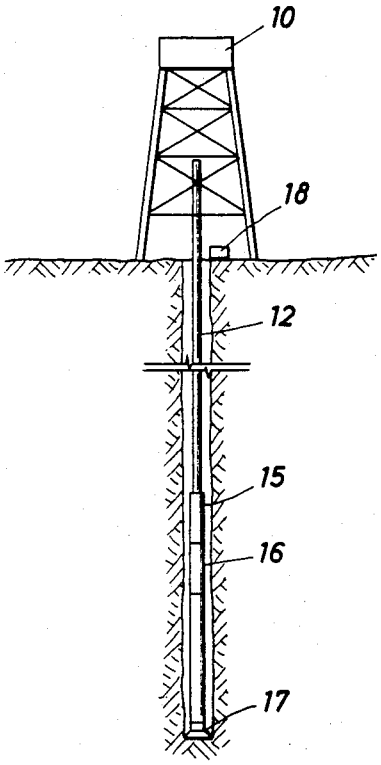
FIG. 1 shows a drill string protected by the safety joint of the present disclosure.

Attention is directed to FIG. 1 which shows a drill string. FIG. 1 will be described first to set out the context of the present disclosure, and, thereafter, details of construction which relate to FIG. 2 will be set forth. In FIG. 1, the numeral 10 identifies a drilling rig of typical construction having an overhead draw works which supports a kelly which, in turn, passes through a rotary table and connects with a drill string. The upper part of the drill string is formed of drill pipe 12 connected with the safety joint 15 of the present apparatus. The safety joint is connected to a set of drill collars 16, and they, in turn, connect to a drill bit 17. The several components are assembled in the customary manner as, for instance, by threading the drill collars to the drill bit. The number and weight of drill collars is typically determined by a number of factors not relevant to this disclosure. It is sufficient to note that several drill collars are installed above the drill bit. If sticking occurs, it normally occurs at the drill collars. The safety joint is located at the top end of the drill collars and is connected to the lower end of the drill pipe 12. In deep wells, the drill pipe might comprise ninety-five percent (95%) of the length of the drill string.

As drilling continues, more pipe is added to the drill string. Under the assumption that sticking occurs, it typically occurs at the drill collars, and the safety joint is, therefore, released for retrieval of at least a portion of the drill string. One or more safety joints can be installed.

Drilling ordinarily occurs with rotation to the right, and, accordingly, the use of API standard threaded connections between drill collars and drill pipe joints assures that righthand rotation tightens each joint. The standard construction is a threaded connection with threads arranged so that rotation to the right keeps the threaded connection tight. Rotation to the left will unthread a threaded joint, and, accordingly, rotation to the left seldom occurs. In the event that rotation to the left does occur, the particular joint which becomes unthreaded cannot be totally controlled or predicted. It is for this reason that unthreading of the drill string by rotation in the wrong direction is not desirable as a means of retrieval of a stuck drill string.

The numeral 18 in FIG. 1 identifies an ultrasonic sound generator which forms signals at specified frequencies and power levels and which is coupled directly to the drill string. As an example, it might form an output signal of 2,000 hertz amplified to a level of 200.0 watts. This output signal is coupled directly to the drill string so that vibrations are imparted to the drill string so that they might travel along the length of the drill string. Its function will be understood in detail on description of the other portions of the apparatus.

Figure 2:
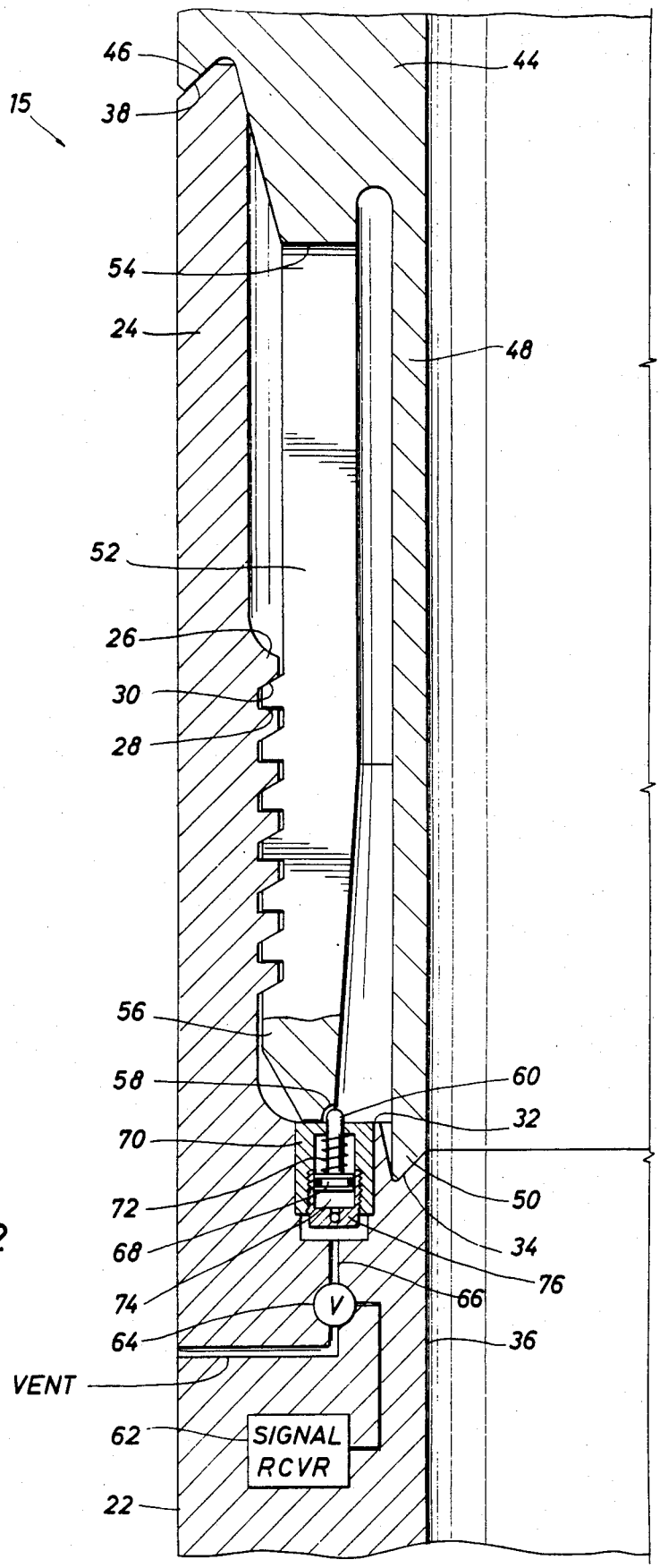
FIG. 2 is an enlarged, detailed view, partly in section, of the safety joint of the present invention including a collected inner tubular member telescoped and threaded to an outer tubular member and held in position by a lock pin.

The safety joint 15, shown in detail in FIG. 2, is constructed with an outer and lower tubular member 22 which incorporates an upstanding outer skirt 24. The skirt 24 is threaded at 26, the threads being constructed in a different profile than customary thread construction. They include a buttress wall 28 on one face of the thread, while the opposite face of the thread is sloping at 30. The opposite face thus defines a shoulder which can permit slippage as will be described. The skirt 24 is thus threaded in the lower portions with this kind of thread.

The skirt terminates at a transverse internal shoulder 32 and is immediately adjacent to a V-shaped groove 34. The outer tubular member is hollow and includes an axial passage at 36. The top end of the skirt 24 is cut into a V-shaped lip 38. The safety joint incorporates an inner tubular member 44 which has an upper body portion with a peripheral V-shaped groove at 46. The groove 46 matches the lip 38 so that they define a common external diameter when they are joined. The lip 38 is received in the groove 46, enabling the two tubular members to join together in the intended manner. The inner tubular member is constructed with an internal elongate skirt 48 which is approximately parallel to the skirt 24. It is smaller and, therefore, telescopes within it. It terminates in a V-shaped lower peripheral lip 50 which enables it to be received in the V-shaped groove 34 previously mentioned. The two skirts 24 and 48 thus define an internal cavity between them which is isolated from the mud flowing through the drill string and the mud flow through the annular space. The upper tubular member 44 thus supports a set of collet fingers 52 which are spaced between the aforementioned tubular skirts.

The collet fingers 52 are defined by parallel adjacent slots which terminate at the upper end of the slots indicated in dotted line at 54. There are several identical collet fingers.

The collet fingers are collectively cut with a mating thread. The thread cut on the exterior of the collet fingers matches the thread 26 on the interior so that threaded connection can be made. They are threaded together on right-hand rotation so that continued drilling tightens the threaded connection. The several collet fingers are collectively cut with the threads, yet each one is individually cantilevered, thereby permitting each individual collet finger to deflect radially inwardly away from the threads for disengagement. An upward pull separates the two threaded members whereby the collet fingers deflect inwardly and ride over the threads on the outer tubular member. To this end, the sloping face 30 on the threads enables overriding movement as disengagement is achieved. Once the collet fingers ride up onto the top of the threads, an extra wide shoulder 56 rides on top of all the threads, being wider than a single thread. At the time of manufacture, the thread is not chased all the way to the end of the collet fingers.

The collet fingers are constructed with a notch 58 at the lower end which is cut on the inside face. Radial inward deflection is permitted if, and only if, the notched area is clear. If the notch is blocked, the collet fingers are not free to deflect inwardly. The apparatus is preferably constructed with a specified number of collet fingers (four, as an example), and there are several pins as will be described which block the collet fingers. It is not necessary to block all of them; it is preferable to block more than one, although, in theory, one will hold. To avoid maldistribution of the stresses created, the optimum arrangement is to utilize a lock pin for each collet finger. As viewed in FIG. 2, a lock pin 60 protrudes upwardly and adjacent to the collet finger. The collet finger is not free to move radially inwardly until a lock pin has been removed. The lock pin fits within the notch 58 and prevents accidental disconnection of the safety joint 15.

FIG. 2 further discloses a means for retracting the lock pin. The numeral 62 identifies an ultrasonic signal receiver which, in turn, operates a relief valve 64. The valve 64 is normally closed and vents downhole. It opens downhole to relieve hydraulic fluid on operation. The valve 64 is connected with a passage 66 which, in turn, connects with an assembly which holds the pin 60 in the up position. The pin 60 is attached to a piston 68 which is received within a cylinder housing 70. The piston 68 is forced downwardly by a retraction spring 72 which bears against the piston to move it downwardly. The piston 68 is held in the up position by hydraulic oil received in a reservoir 74 filled with hydraulic oil. The oil is held there by the valve 64.

The cylinder 70 and the associated apparatus is received in a recess formed in the lower tubular member 22. Because of the scale of the components, the pin need not be very large, and its stroke or travel is also relatively small. The pin 60 is thus relatively small, held up only by a small quantity of hydraulic fluid. The cylinder 70 is closed by a threaded plug 76 which completes the closed hydraulic oil chamber. The passage 66 connects to the chamber 74 through the bottom plug 76.

When the apparatus is installed, it is passive in operation. The pin 60 is held up at all times and is installed by filling the chamber 74 with hydraulic fluid and also filling the line 66 with hydraulic fluid. With the valve 64 closed, the fluid is trapped. When the signal receiver 62 receives the signal, it operates the valve 64 to thereby retract the pin 60. As hydraulic oil is removed, the pin withdraws at the urging of the coil spring 72, and hydraulic oil is forced out of the system. The coil spring 72 applies pressure to the hydraulic oil to force it from the system. Subsequently, the system can be recharged on closing the valve 64. This ordinarily occurs at the surface in dressing the tool and preparing it for subsequent use.

The signal receiver 62 is preferably tuned to the particular frequency which is encoded by the signalling device 18 at the surface. It is preferably provided with a notch filter tuned to that frequency so that it will not respond to other signals. An ultrasonic signal has the form of vibration in the metal structure. The vibration that travels down the drill string might be comingled with vibrations resulting from physical operation. To this end, it is preferable to choose a frequency which is quite remote from the common vibration modes experienced by the drill string in use. It is further preferable to use a high frequency and long duration signal to trigger opening. For example, if the dominant frequencies experienced by the drill string in conventional operation for drilling a well includes frequencies below 2,000 hertz, the signal used to trigger the equipment should be quite high, well out of the dominant range. Moreover, it should be a fairly intense signal maintained for a significant duration such as 10.0 seconds or longer. If a 100.0 watts signal is impressed by means of a suitable transducer at the wellhead, a very significant signal level is experienced at the bottom of the drill string even in those wells which are quite deep. The precise frequency and signal power may well vary dependent on many factors, and the preferred frequency and power may well need verification by field testing. As an example, two variables which alter the frequency and power are the length of the drill string and particular pipe (size and metal) making up the drill string. Damping by the mud may well vary. Further, the geology may well alter requirements. The spring excursion is very small, and it need only total a few thousandths of an inch to open the valve. The opening may last only a fraction of a second; this is sufficient. Dependent on frequency choice, two differently tuned safety joints can be used independently in the same drill string.

The signal receiver 62 thus detects the ultrasonic signal coupled down the drill string and triggers operation of the valve 64 to initiate leakage. The hydraulic oil is leaked out, and the equipment is triggered to retract the pin. Thereafter, an upward pull on the drill string will separate the drill string at the safety joint by pulling the upper tubular member 44 free of the lower tubular member 22.

Inasmuch as several collet fingers are used and they are all preferably blocked by several pins, it is necessary to release all pins from the blocking position. To this end, the valve 64 is connected with the passage 66 which connects to each and every pin. They are all connected in parallel so that they all drain through a single valve 64.

The safety joint is installed in the drill string by typical threaded connections with API standard pin and box fittings. When the safety joint separates, the lower tubular member 22 is left with the string in the well, and the upper tubular member is retrieved with the drill pipe. A fishing job thereafter will typically attempt threading up with the threads at 26. Because the diameter and shape of the threads are known, the fishing job is made easier.

Figure 3:
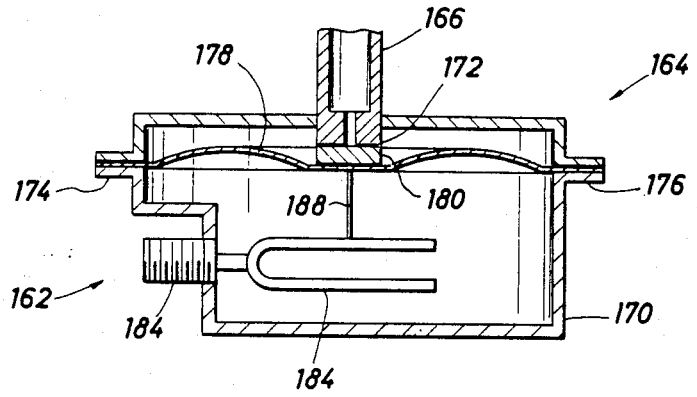
FIG. 3 is a lock pin hydraulic oil release apparatus responsive to ultrasonic signals which are transmitted along the drill string.

Attention is directed to FIG. 3 of the drawings, where a form of signal receiver 62 is illustrated. In FIG. 3 of the drawings, the numeral 166 identifies the passage corresponding to the passage 66 in FIG. 2. It is connected to the valve apparatus generally identified at 164 corresponding to the valve 64 of FIG. 2. The signal receiver 162 is likewise incorporated in FIG. 3. Briefly, a chamber 170 is constructed in the lower tubular member 22. The chamber is integrally constructed within the lower tubular member so that it experiences ultrasonic vibrations moving through the drill string. The passage 166 terminates at an opening 172 in the chamber 170. It is the entrance into the chamber for venting hydraulic oil. The chamber 170 receives the remainder of the apparatus, and it is desirable that the chamber 170 be drained elsewhere, as, for instance, to the exterior of the tool. The chamber 170 has a small slot 174 and a diametrically opposing slot 176 on the opposite side. They anchor and support the tips of a transverse spring 178. The spring 178 can be made in several forms. For instance, it can be circular, received in an encircling groove or continuous single slot. Alternatively, it can be an elongate leaf spring having two ends which are received in the facing slots. The spring 178 is fixed in location and is in contact with the body of the safety joint so that vibrations traveling through the safety joint are received and imparted to the spring 178.

The spring 178 is constructed to have a dominant frequency at which it will vibrate. A frequency is selected to match the ultrasonic transmitter frequency of the signaling device at the surface. The spring 178 is ideally a relatively high Q device, having a Q typically in the range of 20.0 to 200.0, depending on scale factors. The high Q spring supports a resilient plug 180 attached to the spring by a suitable adhesive and which plugs against the passage 166 to block flow. The relative surface area of the passage 166 is quite small, and the resultant force bearing against the plug 180 is relatively small, even though the pressure in the passage 166 might be high. The plug 180 is a valve element which stops flow. The plug 180 is forced downwardly by the pressure acting on it and is forced upwardly by the spring 178. The spring is shaped so that it will hold the plug up against the opening and prevent leakage of hydraulic oil.

The spring is constructed and arranged so that the upward force is maintained even when the tool undergoes random vibration of any frequency in any dimension. When the ultrasonic signal to which the spring is responsive is applied to the apparatus, the spring responds by vibrating in a more violent mode. As the range of vibrations become wider, they tend to pull the plug open. The spring is shaped and supported so that it will not open solely on vibration of the spring 178. The spring 178 partially releases the average force bearing on the plug 180.

The numeral 184 identifies a threaded, mounted mounting plug fixedly attached in a threaded opening for supporting a frequency sensitive tuning fork 186 of moderately high Q, typically 20.0 and up. It is sensitive to a selected frequency, preferably quite different from the frequency that is sensed by the spring 178. The tuning fork 186 responds to the vibrations which are imposed on the structure and vibrates in sympathy with the ultrasonic signal applied to the drill string if, and only if, it matches the frequency of the fork 186. The tuning fork 186 is thus a notch filler in the same fashion as the spring 178.

The tuning fork 186 initiates a mode of vibration, the vibration being coupled by the connective member 188 to the spring 178. When both high Q vibrating receivers vibrate, the vibrations reinforce one another as coupled through the connective member 188, and, on enforcing, they pull the plug 180 away and thereby open the valve. Preferably, the connective member 188 is flexible and pliant. Thus, it can only be pulled. When the vibrations occur in the tuning fork and pull downwardly in conjunction with the vibration sensed by the spring 178, both pull the valve element 180 away from the plug and thereby open it. It is not important that it is opened only momentarily. While this may be true, as long as both modes of vibration persist, opening of the plug occurs repetitively, and the hydraulic oil will flow through the passage 166. The bleeding will be cumulative, thereby voiding the hydraulic oil in the system and permitting the pin 60 to be retracted.

Consider, as an example, two representative frequencies, a lower frequency of 2,200 hertz and a higher frequency of 7,000 hertz. It will be appreciated that they mutually reinforce many times in a second, and the valve is thereby opened. Depending on scale factors, it tends to snap shut when reinforcement does not occur. However, momentary opening continues as long as the signals are applied to the drill string, and the hydraulic oil is drained from the system. It is no detriment at all if it requires a minute or two to drain the hydraulic oil. Indeed, it is desirable that it take a long time for the oil to be drained. If, for instance, eighty percent (80%) of the oil must be removed before the pin is adequately retracted, this ordinarily requires a significant interval. It is desirable that it be relatively slow in operation.

Figure 4:
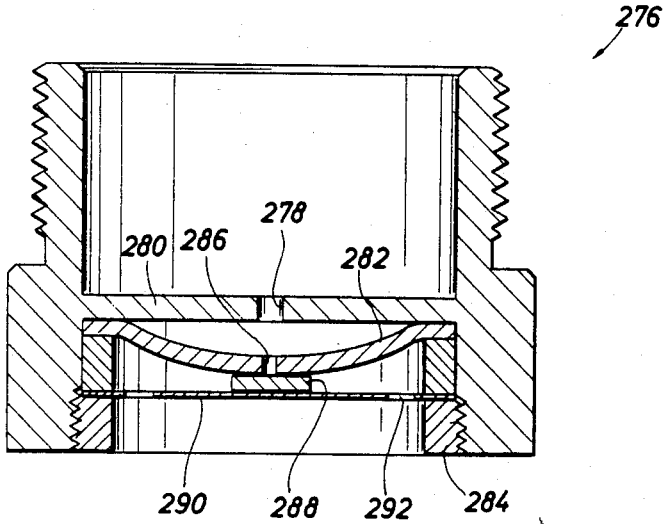
FIG. 4 is an alternate ultrasonic responsive apparatus for releasing a lock pin which prevents accidental release of the safety joint of the present invention.

In FIG. 4 of the drawings, an alternate embodiment to the structure of FIG. 3 is illustrated. FIG. 4 discloses a modified plug 276 incorporating a threaded tubular plug to be placed in the hollow cylinder 70 to capture hydraulic oil. It is provided with a threaded body so that it connects with the cylinder 70. It stores and holds hydraulic oil in the same fashion as the structure shown in FIG. 2. Hydraulic oil is captured within the plug 276 and is permitted to escape through an opening 278 formed in a transverse bottom plate 280, defining the bottom of the plug 276.

Oil which flows through the opening 278 does not escape, however, because its path is still blocked. A disk spring having a crown is identified at 282, and it has a periphery which is clamped by a lock ring 284. The lock ring 284 jams against the periphery of the disk spring 282. The disk spring 282 has a perforated opening 286 which is a mode of egress for oil. It is, however, plugged by a resilient seal member 288 supported by a second spring 290 in the form of a disk. The spring 290 has a number of perforated openings at 292 which provide a flow path from it. The disks 282 and 290 are both springs which have a characteristic resonant frequency. They are both circular disks which are clamped at the outer periphery to the plug body which, in turn, clamps them to the drill string where all vibrations in the drill string impinge on them. The lock ring 284 locks the first spring in position and supports the second so that both are able to vibrate. They are constructed and arranged so that vibrations coupled through the drill string are imparted to them. When the resonant frequency is achieved, they begin vibrating, and they vibrate at differing frequencies with differing amplitudes. During vibration, the two disk-shaped springs vibrate toward and away from one another. The resilient member 288 is adhesively attached to the lower spring, but it pulls free of the upper spring. During vibration, oil is, therefore, transferred through the port 286, flowing above the disk 290 and through the ports 292. This drains oil and thereby enables the pin to be retracted. The two springs are responsive to different frequencies. Periodically, during vibration, they open, thereby draining off small quantities of hydraulic oil. Over a period of many seconds, they will drain a sufficient quantity of oil to release the safety joint for opening. They are preferably high Q springs (perhaps 20.0 and up) and have different characteristic frequencies of vibration.

Figure 5:
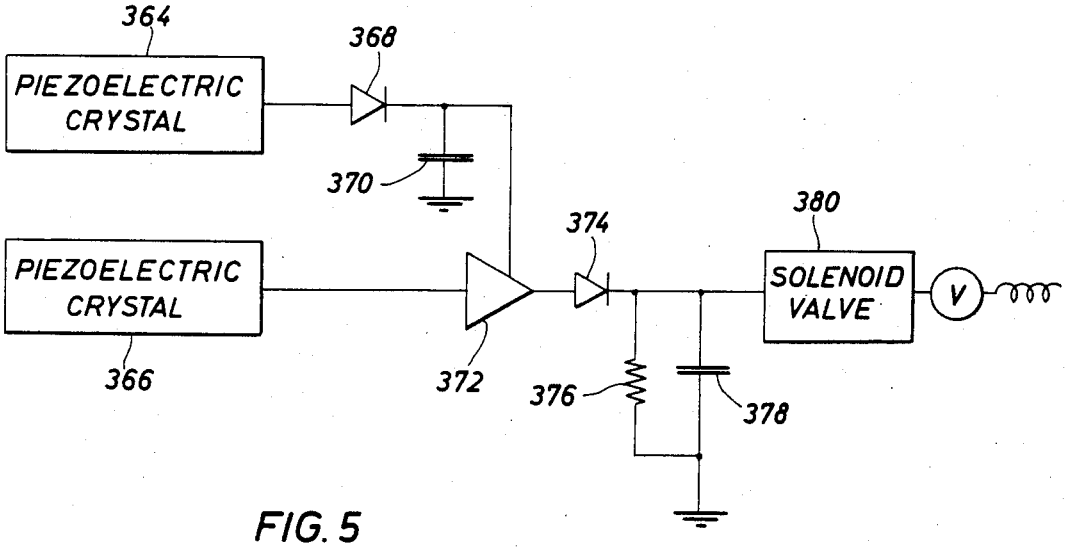
FIG. 5 is another alternate embodiment of a lock pin release apparatus.
Figure 10:
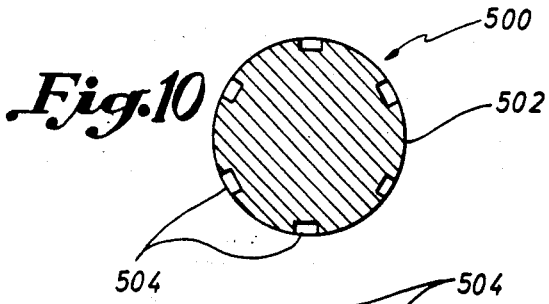
FIG. 10 is a sectional view taken along line 10—10 of FIG. 9.

FIG. 5 discloses a third alternate form of apparatus. A first piezoelectric crystal 364 is responsive to a selected frequency. A second crystal 366 responsive to an alternate frequency is also included. They are passive devices in that they consume no electrical power; when they sense the right frequency, they vibrate and thereby form an electrical output signal between a pair of opposing faces in the customary manner. The first crystal 364 is connected through a diode 368. It charges a capacitor 370 which forms a voltage for operation of an amplifier 372. The other crystal 366 is connected to the input of the amplifier 372 and forms an output which is supplied through a diode 374. The diode 374 is then connected to a resistor to ground 376 and a parallel capacitor 378. A solenoid valve 380 is operated to open the passage 66. It is held open while voltage is applied to it.

One of the crystals forms an operating voltage, which the other crystal forms a voltage for the amplifier 372. The amplifier 372 serves the function of an "and" gate in that it forms an output if both crystals detect vibrations of specific frequencies. Again, they are relatively high Q devices, typically in the range of 20.0 or better.

If both vibratory signals are present in the drill string, they are sensed by both crystals, and they form the requisite output signals which cause the solenoid valve operator 380 to operate. Preferably, the solenoid valve operator 380 connects to a valve which is opened on the application of power to the solenoid and is spring returned to close at other times. The valve passage is sized so that it requires many seconds, perhaps a minute or so to drain the hydraulic oil from the valve 380.

As an example of one mode of application of the safety joint of the present invention, assume it is equipped with two transmitters. One is set to operate at 2,900 hertz, and the other operates at 3,400 hertz. If both signals are present and persist for several seconds, perhaps 50.0 to 100.0 seconds, then the pins 60 are removed as a preliminary step to disconnection of the safety joint.

It may be desirable to accomplish mechanical actuation of the safety joint mechanism in order to induce it to release in controlled manner. In accordance with this invention, a mechanically released safety joint mechanism may conveniently take the form illustrated in FIGS. 6A–8 where a safety joint mechanism is illustrated generally at 400. The mechanically actuated safety joint mechanism includes an upper connection sub 402 that is formed to define an internally threaded upper portion 404 which is adapted to receive the lower externally threaded extremity of a section of conventional drill pipe. The sub 402 is formed to define a reduced diameter externally threaded portion 406 that receives the upper internally threaded portion 408 of a connecting sub 410. The connecting sub is formed to define an internal flange 412 that forms an upwardly facing annular abutment shoulder 414 the purpose of which will be described hereinbelow. The lower portion of the connecting sub 410 is formed internally to define a plurality of internal spline receptacles 416 that are adapted to receive respective elongated spline elements 418 formed on a reduced diameter portion 420 of a lower sub 422. The upper extremity of the lower sub 422 is formed to define an externally threaded pin portion 424 having typical pipe threads that are adapted to be received within an internally threaded box portion of a conventional section of drill pipe or a well tool after the safety joint has been released and extracted from the well. An annular sealing element 426 is received within an appropriate seal groove defined within the connecting sub 410 and establishes a seal with a cylindrical sealing surface 428 defined between the threads 424 and the external splines 418. The splined connection between the connecting sub 410 and the lower sub 422 is for the purpose of transmitting drilling torque between the connecting sub and lower sub. The particular number of splines that are utilized in the torque or force transmitting connection between the connecting sub and lower sub may vary depending upon the torque forces to be encountered and the particular design of the apparatus itself. For example, four splines may be employed, each being offset 90° apart. The splines are arranged in parallel manner in order that the connecting sub and lower sub may be separated at the joint 430.

It is desirable to retain the connecting sub 410 and the lower sub 422 in assembly during normal drilling operations and during normal running of drilling pipe into the well or extraction of drilling pipe from the well. Under circumstances where the drilling pipe becomes stuck and it becomes necessary to separate the drill string at the safety joint, a mechanical mechanism for accomplishing such separation may conveniently take the form illustrated in FIGS. 6A and 6B. A collet element 432 is positioned within the connection sub 410 and includes a plurality of depending collet fingers 434 each having a threaded section 436 at the lower extremity thereof. The threaded section 436 of each of the collet fingers is maintained in threaded engagement with an internally threaded section 438 defined within and intermediate the extremities of the lower sub 422. Here again, the collet fingers are collectively cut with a mating thread and are collectively received by the internally threaded section 438 of the lower sub. The threads are formed together on right hand rotation so that continued drilling tightens the threaded connection. Each of the collet fingers is flexible thereby permitting the collet fingers to deflect radially inwardly away from the threads for disengagement. The external threads of the collet fingers are formed with downwardly and outwardly sloping surfaces 440 at the upper portion thereof which react in cam-like manner with upwardly and radially inwardly tapering surfaces 442 defined by the internal threads of the lower sub. This cam-like reaction causes the collet fingers 434 to be urged radially inwardly as an upwardly directed force is applied to the collet fingers. Of course, this upwardly directed force will be applied only under circumstances where the safety joint mechanism has been actuated for release and the upwardly directed force is applied during pulling of the drill pipe from the well.

The upper extremity of the collet 432 is formed to define an externally threaded portion 444 that is received within an internally threaded portion 446 of a collet retainer sub 448. The sub 448 is formed internally to define a hexagonal opening 450 which is shown in FIG. 7. The threaded connection of threads 444 and 446 is made up or broken out by inserting an appropriate tool within the hexagonal opening 450 and rotating the tool in the appropriate direction, thus rotating the collet retainer sub 448 in the appropriate direction for threading or unthreading. The lower extremity of the collet retainer sub is formed to define an annular shoulder 452 that is adapted for abutting relation with the support shoulder 414 defined by the internal flange 412. The upper portion of the collet retainer sub is defined by an annular abutment surface 454 that is restrained by the stop surface 456 defined at the lower extremity of the upper sub 402. Thus, the retainer sub 448 is entrapped between abutment shoulders 414 and 456 and is capable only of very limited movement. Thus, the collet 432 is also restrained by virtue of its threaded connection with the collet retainer sub.

As mentioned above, the safety joint mechanism of FIGS. 6A and 6B is capable of being mechanically released by means of releasing apparatus that is controlled at the surface of the well. It is also desirable to insure that release of the safety joint mechanism occurs only under specifically selected releasing control and is not capable of becoming inadvertently released during normal drilling operations. As shown in FIG. 6B, a release piston 458 is positioned within the lower sub 422 and is provided with upper and lower external seals 460 and 462 that engage an internal cylindrical surface 464 defined within the lower sub to thereby establish a sealed engagement between the release piston and the internal surface of the lower sub. The release piston 458 is formed at the upper extremity thereof to define a reduced diameter axially extending portion 466 defining a tapered external surface 468 that is adapted for caming engagement with correspondingly tapered cam surfaces 470 defined on each of the collet fingers 434. The cam surfaces 470 are formed with respect to each collet finger such that internal recesses are defined on each of the collet fingers which recesses receive the upper tapered extremity 466 of the release piston 458. Stop shoulders 472 defined on each of the collet fingers prevent the release piston from moving upwardly beyond the set position shown in FIG. 6B. As long as the upper portion 466 of the release piston is positioned within the respective collet finger recesses, the cam surface 468 will bear against cam surface 470 and thereby maintain the threaded sections 436 of each of the collet fingers in threaded assembly with the internally threaded section 438. With the release piston shown in the position of FIG. 6B, it is not possible for the collet fingers to release the threaded connection thereof with the internally threaded section 438 of the lower sub.

It is desirable, of course, to prevent the release piston 458 from inadvertently moving downwardly during normal drilling and pipe handling operations so that inadvertent release of the safety joint will not occur. As shown in FIG. 6B, a plurality of shear bolts 474 are received within appropriate apertures formed in the collet fingers and are threaded within internally threaded openings defined within the upper portion 466 of the release piston. The shear bolts 474 cannot back out inadvertently and release the piston 458 from the collet fingers because of the limited clearance between the bolts and the internal surface 464 of the lower sub. In order to move the release piston 458 downwardly and release the collet fingers 434 for releasing movement, it is necessary that sufficient downward force be applied against the release piston 458 to shear the bolts 474. The shear bolts are composed of any suitable metal or other material that will allow shearing to occur within a particularly designed shear force range.

Figure 12:
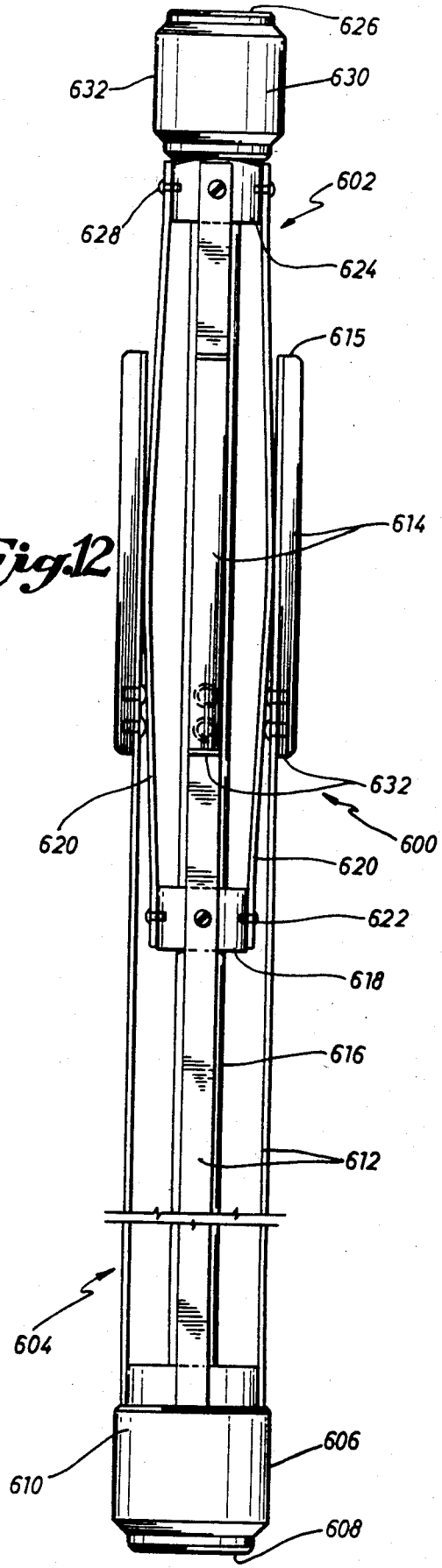
FIG. 12 is a side view of a release tool for achieving mechanical release of the safety joint of FIGS. 6A and 6B.

To accomplish downward movement of the release piston 458 and to shear the bolts 474, the release piston is formed internally to define a piston actuator receptacle 476 within which the actuating portion of the release tool is received to establish a connection between the release tool and the release piston. The release tool is illustrated in FIG. 12 and is described hereinbelow.

The safety joint mechanism is completed by means of a bottom sub 478 having an externally threaded upper portion 480 that is received by internal threads 482 defined within the lower portion of the lower sub 422. The lower portion of the bottom sub 478 is defined by an externally threaded axially extending portion 484 defining a standard drill pipe pin connection that is adapted to be received by the box portion of a standard drill pipe connection. The bottom sub 478 is also formed internally to defined an annular enlargement or tool receptacle 486 within which a portion of the rlease tool is positioned after disengagement of the collet fingers has occurred.

Figure 9:
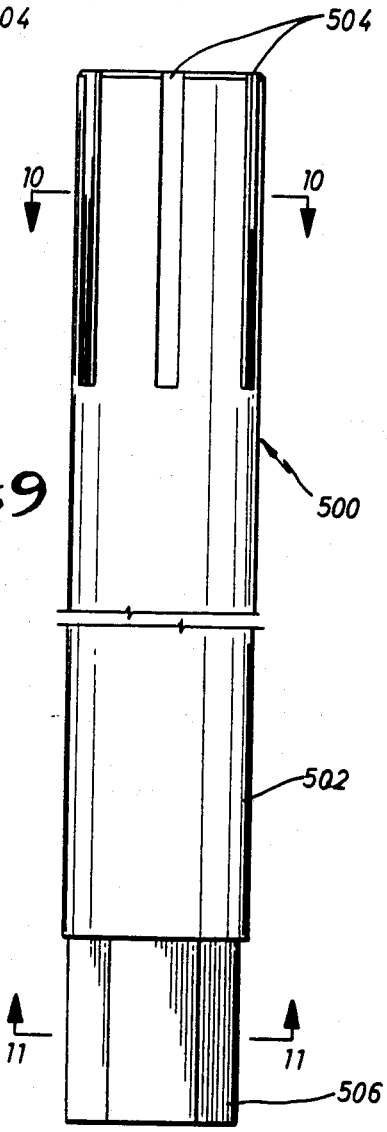
FIG. 9 is a side view of an assembly tool for assembly of the safety joint of FIGS. 6A and 6B.
Figure 11:
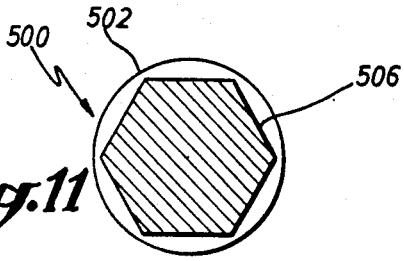
FIG. 11 is a sectional view taken along line 11—11 of FIG. 9.

Referring now to FIG. 9, there is depicted an assembly tool, shown generally at 500, which is essentially of elongated generally cylindrical form defining a cylindrical body 502 that is formed at the upper extremity thereof to define a plurality of generally parallel keyways 504. The keyways receive any suitable tool that is capable of rotating the assembly tool 500. At the lower portion of the assembly tool is provided a hexagonal drive portion 506. With the upper sub 402 of the safety joint 400 removed from the upper portion of the connecting sub 410, the hexagonal drive portion 506 of the assembly tool is inserted within the hexagonal drive opening 450 of the collet retainer sub 448. The assembly tool is then rotated by applying a rotary force thereto at the upper splined portion of the assembly tool thereby causing the collet retainer sub 448 to rotate. When this occurs, the threaded connection between the internal threads 446 of the collet retainer sub and the external threads of the collet 432 will be made up, thereby positioning the safety joint apparatus in the set position thereof. It should be borne in mind that the assembly tool 500, upon rotating the collet retainer sub 448, also causes the threaded relationship between the threaded sections of the collet fingers and the internal threaded section of the lower sub to be made up. The collet 432 with the sleeve piston 458 attached thereto and retained in assembly by means of the shear bolts 474, is inserted upwardly from the bottom of the lower sub 422 with the bottom sub 478 removed. After the collet 432 has been properly positioned with respect to the connecting sub 448 and has also been properly threaded into engagement with the internally threaded section 438 of the lower sub 422, the safety joint will be firmly locked in assembly. Thereafter, the safety joint assembly procedure is completed simply by threading the bottom sub 478 into engagement with the lower threaded extremity 482 of the lower sub.

Drilling operations will continue normally with the assembled safety joint in the position illustrated in FIGS. 6A and 6B. In the event the drill stem should become stuck in the well bore below the safety joint, the safety joint provides an efficient means for accomplishing separation of the drill stem at a known position along the length of the drill stem. As mentioned above, the drill stem may incorporate several safety joints, each of which may be selectively actuated in the manner described above. The drill stem then may be withdrawn from the well bore in large sections broken at each safety joint, thereby simplifying removal of the drill stem and insuring that the fishing operation that is subsequently conducted concerns only the stuck portion of the drill stem.

To accomplish mechanical release of the safety joint, a hydraulically energized release tool of one suitable form is provided which is shown generally at 600 in FIG. 12. The release tool incorporates inner and outer telescoping elements shown generally at 602 and 604 respectively. The outer telescoping element 604 incorporates a piston element 606 at one extremity thereof which is formed by a metal core 608 having an elastomeric covering 610 provided thereon. The outer dimension defined by the elastomeric covering 610 is slightly larger than the inside dimension of the bottom sub defined by cylindrical surface 481. When the piston 606 is positioned within the bottom sub, the elastomeric material 610 will be slightly deformed to a tightly fitting, sealed relationship with respect to the cylindrical surface 481. From the metal core 608 extends a plurality of cantilevered elements 612 each having retainer pads 614 connected at the free extremities thereof. Additionally, a guide rod 616 extends from the metal core 608 and receives a guide bushing 618 thereabout. The guide bushing 618 also forms one extremity of the inner telescoping member 602. The inner telescoping member further comprises a plurality of spring elements 620 that are each secured at one extremity thereof to the guide bushing 618 by means of a plurality of screws or bolts 622. The spring elements 620 are secured at the opposite extremities thereof to an axially extending portion 624 of a metal core 626 by means of screws or bolts 628. The metal core 626 is also provided with a resilient covering 630 similar to the covering 610 defined on the piston structure 606, thereby also defining a piston structure 632 at the opposite extremity of the release tool. The spring elements 620 are each of curved configuration thereby rendering the internal telescoping member 602 radially compressible intermediate the extremities thereof. The spring elements also contact the cantilevered elements 612 near the free extremities thereof and in the vicinity of the retainer pads 614. The springs provide a force transmitting capability that urges the cantilevered elements 612 radially outwardly thereby urging the retainer pads radially outwardly in the same manner.

The release tool 600 is capable of being transmitted or "pumped" downwardly through the drill string by hydraulic activity generated by the mud pumps of the drilling apparatus. In order to accomplish release of the drill string at the safety joint, the release tool is placed within the drill string and is pumped downwardly through the collective bores of the individual sections of drill pipe. The retainer pads 614 will be in engagement with the cylindrical internal wall surfaces of the drill pipe during downward traversing and the springs 620 will be collapsed sufficiently to accommodate positioning of the retainer pads within the drill pipe. When the release tool has been pumped downwardly sufficiently to bring the retainer pads 614 into registry with the piston actuator receptacle 476, the radial forces induced by the compressed springs 620 will urge the retainer pads 614 radially outwardly into received relationship within the piston actuator receptacle. When this occurs, a mechanical connection will have been established between the release tool and the release piston 458. When this activity occurs, the piston 606 at the lower extremity of the release tool will have been positioned within the cylindrical upper bore 481 of the bottom sub 478 and will have established a sealed or plugged relationship therewith in the manner explained above. Since the upper piston 632 of the release tool will be positioned within the bore 467 of the release piston, the drilling fluid will continue to move the inner telescoping member 602 downwardly until such time as the piston 632 enters the piston actuator receptacle and becomes positioned between the retainer pads 614. When this has occurred, the piston 632 will form a mechanical backup for the retainer pads 614 and will prevent the retainer pads from moving radially inwardly and becoming disassembled from the piston actuator receptacle 476. Likewise, positioning of the piston 632 between the retainer pads 614 will allow the drilling mud or other pumping medium to circulate past the piston 632. At this point, the hydraulic fluid will develop a downwardly directed force against the lower piston 606 thereby tending to move it through the bore 481 and into the receptacle 486 of the bottom sub 478. In order for the piston 606 to move in this manner, it must shift the cantilevered elements 612 and the retainer pads 614 downwardly. As the retainer pads 614 are urged downwardly, a downwardly directed force is transmitted by the retainer pad shoulders 632 against the internal annular shoulder 477 of the release piston. In order for the release piston to move downwardly, the shear bolts 474 must become sheared. Therefore, sufficient hydraulic force is induced against the lower piston 606 to develop sufficient force to shear the bolts 474. After this has occurred, the release piston 458 will then move downwardly causing the cam surfaces 468 and 470 to become disengaged and thereby releasing the collet fingers 434 for radially inward movement. The release piston 458 will move downwardly sufficiently to bring the lower shoulder 479 thereof into engagement with the upper shoulder 481 of the bottom sub 478. This amount of downward movement will also allow the lower piston 606 of the release tool to move within the piston receptacle 486 of the bottom sub. Thereafter, the hydraulic fluid will circulate around the lower piston thereby causing the downwardly directed force applied to the release piston to be dissipated. Likewise, a pressure drop will occur in the hydraulic fluid as soon as the shear bolts 474 are sheared and the release piston 458 is moved by the release tool to its lower most position within the safety joint. This pressure drop is readily detected at the surface, thereby giving drilling personnel a positive indication that the safety joint has been released. The drill pipe located above the safety joint, together with the upper portion of the safety joint will then be capable of being withdrawn from the well simply by moving the drill pipe upwardly. The lower sub 422 of the safety joint will then remain in the well along with any connector subs or drill pipe located below it, together will the drill bit or other apparatus that is connected at the lower end of the drill stem. Fishing operations may then be conducted simply by lowering a fishing tool into the well and threading it onto the upwardly exposed threaded pin 424.

If, for some reason, it becomes appropriate to withdraw the release tool from the safety joint with the safety joint either in the released or unreleased condition thereof, this may be accomplished simply by reversing the flow of the hydraulic fluid to apply an upwardly directed force against the release tool. The upper portion of the piston actuator receptacle 476 is defined by a tapered cam surface 475 that is engaged by the upper extremities 615 of each of the retainer pads 614. The tapered cam surface 475 urges the retainer pads 614 radially inwardly sufficiently to accommodate the dimension of the release piston bore 467 and the dimension of the bore defined by the well pipe. The release tool then simply may be pumped to the surface and recovered.

Figure 13:
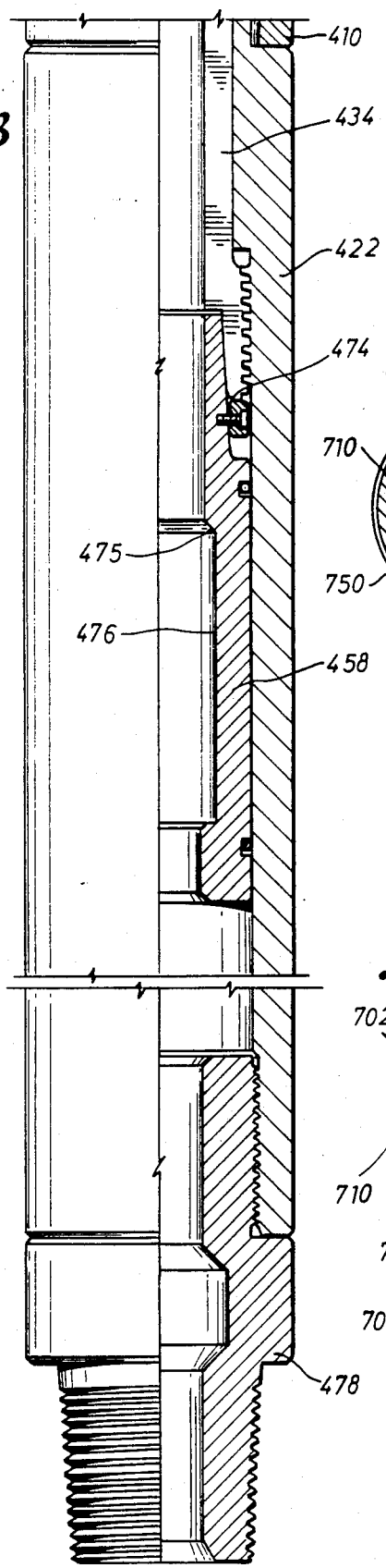
FIG. 13 is a quarter sectional view of a lower portion of a safety joint mechanism similar to the structure illustrated in FIG. 13.

A pump down type release tool mechanism and its relationship with the release portion of the safety joint mechanism may take other convenient forms such as illustrated in FIGS. 13–16 where there is shown an alternative embodiment. As shown in FIG. 13, the lower portion of the safety joint mechanism may be substantially identical with the lower portion shown in FIG. 6B. Corresponding reference characters are, therefore, utilized to illustrate corresponding parts.

Figure 14:
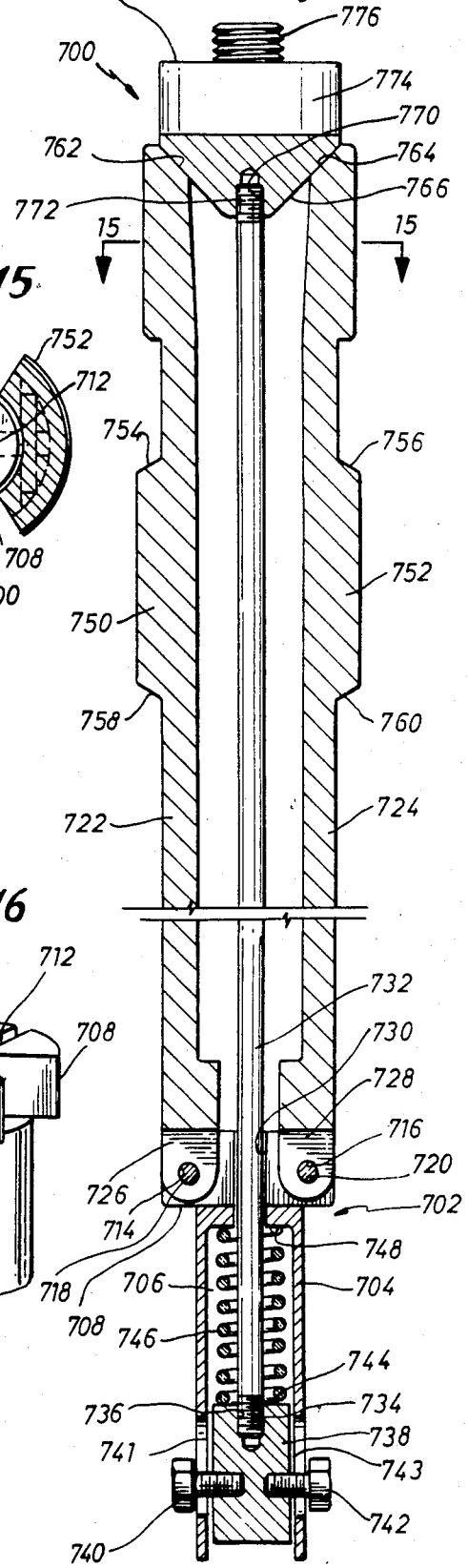
FIG. 14 is a sectional view of a pump down type release tool representing an alternative embodiment of the present invention.
Figure 15:
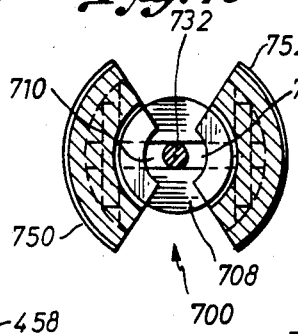
FIG. 15 is a transverse sectional view taken along line 15—15 of FIG. 14 and illustrating an upper portion of the release tool in detail.
Figure 16:
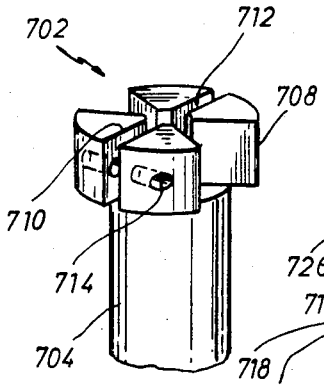
FIG. 16 is an isometric view of the lower portion of the release tool of FIG. 14 with the locking arm disassembled therefrom. in detail.

Referring now to FIG. 14, a release tool mechanism is illustrated generally at 700 which incorporates a lower mounting base structure shown generally at 702 and which is also illustrated in the isometric view of FIG. 16. The mounting base structure incorporates a lower, generally tubular housing 704 that defines an internal spring chamber 706. The upper portion of the mounting base structure defines an enlarged connector head 708 which is segmented in such a manner as to define a pair of locking arm support slots 710 and 712. The head portion 708 is further formed to define transverse bores 714 and 716 within which are received pivot support pins 718 and 720 respectively. A pair of elongated locking arm elements 722 and 724 are formed to define lower connector portions 726 and 728 respectively having apertures formed therein for the purpose of receiving the pivot pins 718 and 720. The pivot pins secure the lower portions of the locking arms 722 and 724 in pivotal assembly within respective ones of the slots 710 and 712.

The upper head portion 708 of the lower mounting base structure is also formed to define a centrally oriented bore or passage 730 through which extends an actuating rod 732.

The lower extremity of the actuating rod 732 is formed to define an externally threaded lower portion 734 that is received within an internally threaded opening 736 defined in a connector block 738. The lower tubular portion 704 of the mounting base structure is formed to define elongated connector guide openings within which are received bolt elements 740 and 742 or other suitable connector and guide devices that secure the connector block 738 in movable assembly within the lower portion of the spring chamber. The connector block defines an upper abutment surface 744 against which the lower extremity of a compression spring 746 is positioned. The compression spring is interposed between the lower abutment surface 744 and an upper abutment surface 748. The guide openings 741 and 743, through which the connector bolts 740 and 742 extend, are of elongated configuration and, therefore, allow linear movement of the connector block 738 within limits defined by the length of the guide openings. Thus, the connector block 738 is allowed to move linearly and the actuating rod 732, being secured to the connector block 738, is also allowed linear movement relative to the lower mounting base structure.

Each of the locking arms 722 and 724 are formed intermediate the extremities thereof to define retainer pads 750 and 752 that are adapted to be received within the piston actuator receptacle 476 of the piston 458. The upper and lower extremities of the retainer pads are formed to define tapered cam surfaces 754 and 756 for caming reaction against the tapered cam surface 475 of the release piston. The lower portions of the pads 750 and 752 are also formed to define tapered surfaces 758 and 760. As the arms 722 and 724 pivot outwardly about the pivot pins 718 and 720, the retainer pads will move into the piston actuator receptacle 476 and thus establish a locked relationship between the release tool and the piston. Downward movement of the release tool then will shear the shear bolt elements 474, thus releasing the piston 458 from the collet fingers 434. Release of the safety joint will then take place in the manner described above in connection with FIGS. 6A and 6B.

The upper portion of each of the locking arms is formed to define internally tapered surfaces 762 and 764, which surfaces are engaged by a frusto-conical surface 766 defined on an actuating head element 768. The actuating head defines an internally threaded lower opening 770 within which is received the upper externally threaded extremity 772 of the actuating rod 732. As the actuating head 768 is driven downwardly by the force of the compression spring 746, acting through the actuating rod 732, the frusto-conical cam surface 766 reacting against tapered cam surfaces 762 and 764 will cause the locking arms 722 and 724 to be pivoted outwardly to the expanded position thereof as shown in FIG. 14. This movement causes the retainer pads 750 and 752 to move within the piston actuator receptacles 476 as explained above. The upper, outer portion of the actuator head 768 is defined by a resilient piston portion 774 which surrounds a metal core and is adapted to establish a piston type relationship within the internal passage of drill pipe through which the tool is pumped. As the tool 700 is traversing the drill pipe during pump down activity, the locking arms 722 and 724 will be pivoted inwardly such that the retainer pads 750 and 752 are enabled to pass through the bore of the drill pipe. The upper portions of each of the locking arms will be positioned in closely spaced relation defining a diameter that is equal to or less than the diameter of the piston portion 774. Relative upward movement of the actuating head 768 and the actuating rod 732 to accomplish retraction of the locking arms 722 and 724 achieves compression of the spring 746 and moves the connector block 738 upwardly. This movement energizes the compression spring 746 causing the spring to develop a constant force acting on the actuating rod 732, thus continuously urging the actuating head 768 downwardly. As soon as the retainer pads 750 and 752 come into registry with the piston actuator receptacle 476, the compression spring will urge the actuating rod 732 downwardly thus causing the actuating head 768 to also move downwardly. This downward movement causes a caming reaction to occur between cam surfaces 766, 762 and 764, thus imparting pivotal movement of the locking arms about pivots 718 and 720.

After the release tool has become received in locked assembly with respect to the release piston 458, fluid pressure is simply increased above the piston portion 774 sufficiently to develop the necessary downward force on the release piston to cause the shear elements 474 to shear, thus releasing the piston 458 from the collet fingers 434.

The upper portion of the actuator head is formed to define an externally threaded projection 776 which is adapted to receive the lower internally threaded portion of a retrieving too, not shown. Ordinary retrieval of the releasing tool, however, is accomplished simply by reversing flow through the drill pipe, thus causing the tool to be pumped to the surface by virtue of the piston contact between piston portion 774 and the internal wall surfaces of the drill pipe. The opposed wedge shaped opening defined between opposed portions of the head structure 708 define flow pasages to allow fluid circulation past the release tool if desired.

The foregoing is directed to the preferred embodiment, but the scope thereof is determined by the claims which follow:

I claim:

1. Safety joint apparatus for use in a drill string comprising:

(a) an upper tubular body having a threaded connection with a drill string portion thereabove and further having an axial passage therethrough communicated with the drill string to conduct drilling mud therethrough;

(b) a lower tubular body having a threaded connection with a drill string portion therebelow and further having an axial passage therethrough communicated with the drill string to conduct drilling mud therethrough;

(c) first and second mating threaded tubular surfaces concentrically joined to one another, said threaded tubular surfaces being supported by respective ones of said upper and lower tubular bodies and further including:

(1) threads on one of said mating threaded surfaces formed of coacting helically arranged shoulders, one of said shoulders positioned at an angle to cooperatively receive in threaded engagement therewith the other of said mating threaded surfaces;

(2) wherein said one shoulder is set at an angle to permit the other of said mating threaded surfaces to be pulled free of one of said mating threaded surfaces;

(3) wherein the other of said mating threaded surfaces incorporates a plurality of lengthwise slots to define a set of individual concentrically arranged collet fingers permitting relative radial deflection of said fingers to enable the threads to threadingly engage the threads on the other of said mating threaded surfaces on rotation and to ride over the threads on axial pull to separate said first and second mating threaded surfaces;

(4) lock means for securing said fingers in a radially determined relationship which prevents radial deflection thereof to maintain said first and second mating threaded surfaces in a threaded position preventing axial movement therebetween; and (d) vibration responsive means for securing said lock means in a locking position and operative to release said lock means.

2. The apparatus of claim 1 wherein said vibration responsive means includes first and second vibration responsive high Q mechanical filters secured to the safety joint to receive vibrations traveling along the drill string and wherein said mechanical filters are vibrated in response thereto and have selective output responses forming a minimum output for frequencies outside a selected frequency range and forming a larger output for vibrations within the selected range wherein said filters are connected to a summing means which operates only on receipt of outputs from both of said filter means above a certain output and wherein said summing means alters the position of said lock means.

3. The apparatus of claim 1 including a valve means connected to a chamber adapted to receive and hold hydraulic oil therein, said valve means comprising a valve seat and valve element against the seat for closing said seat against the flow of hydraulic oil therethrough and further including first and second springs operatively connected to said valve means for moving the valve element from said valve seat.

4. The apparatus of claim 3 wherein first and second means for moving said valve element includes springs constructed and arranged to vibrate at specific sympathetic frequencies and further including means for mounting said springs to receive vibrations from the drill string and wherein said springs have dominant frequencies at which they will be responsive to vibrations acting thereon.

5. The apparatus of claim 4 wherein said springs have the form of a pair of leaf springs which are shaped to jointly secure valve seal means against said valve seat and wherein said valve element is moved from said valve seat only on the occurrence of vibrations by both of said springs beyond a certain amplitude for each of said springs.

6. The apparatus of claim 1 wherein said first and second mating threaded surfaces are cut with a buttress thread defined by a crown between a pair of tapering shoulders, when viewed in cross section, and wherein one of said shoulders extends perpendicularly from a concentrically constructed tubular surface.

7. The apparatus of claim 1 including a movable base attached to said lock means wherein said base is received within a surrounding structure, said base supporting said lock means for movement between a locking position and a nonlocking position.

8. The apparatus of claim 3 wherein said lock means further comprises a piston received within a cylinder and having a seal means thereon to define a pressure fluid receiving chamber adjacent to said piston for moving said piston.

9. The apparatus of claim 1 wherein said upper and lower tubular bodies have a common external diameter and wherein one has an extending cylindrical outer skirt adapted to at least partially telescope over the other of said tubular bodies against a shoulder thereon cooperatively receiving said cylindrical skirt and wherein the axial passages within said upper and lower tubular bodies communicate axially with one another and have a common cross-sectional area.

10. The apparatus of claim 1 wherein each of said upper and lower tubular bodies supports concentric sleeves which telescope relative to one another and which are spaced from one another to define an annular cavity and wherein said first and second mating threaded surfaces are within said annular cavity and wherein one of said mating threaded surfaces is cut with a plurality of parallel, lengthwise slots to define collet fingers therein of dimensions enabling said collet fingers to flex radially.

11. A method of controllably disconnecting a drill string into two portions at a safety joint in the drill string where the safety joint incorporates upper and lower tubular bodies threaded together, the method comprising the steps of:

(a) threading together upper and lower tubular bodies to complete the drill string which includes a mud flow path along the drill string through said upper and lower tubular bodies;

(b) locking said threaded tubular bodies together with a lock means to prevent separation of said upper and lower tubular bodies;

(c) securing said lock means energized by hydraulic oil in a locking position by filling a chamber means with hydraulic oil, which oil, when present, secures the lock means in a locking position;

(d) transmitting from the surface along the drill string an ultrasonic signal having a specified frequency and amplitude;

(e) receiving the particular transmitted signal at the safety joint with a receiver means which forms a unique output dependent on the received signal;

(f) opening a valve means in response to operation of said receiver means;

(g) removing oil from adjacent to the lock means through the valve means on operation thereof to enable the lock means to be retracted;

(h) applying an axial pull to the drill string to separate the drill string at the safety joint;

(i) continuing the pull to separate the upper and lower tubular bodies after movement of the lock means; and (j) selectively receiving only specified frequencies of vibration transmitted along the drill string.

12. The method of claim 11 wherein two distinct frequencies of ultronsonic vibration are transmitted along the drill string and including the step of separately receiving at two receiving means the transmitted frequencies, and wherein the valve means is operated only by receiving both the transmitted frequencies.

13. The method of claim 12 wherein the valve means is opened and held open while the two transmitted signals persist and is held open for a finite interval to enable an adequate quantity of oil to be drained through the valve means to thereby release the lock means from a locking position.

14. The method of claim 11 further including the step of positioning the lock means in a locking position by means of the hydraulic oil and providing a continuous force for retracting the lock means by means of a spring means for moving the lock means wherein the continuous force from the spring means is opposed by the hydraulic oil received in a closed system wherein the system is drained by the valve means.

15. The method of claim 11 wherein the step of receiving the vibratory signal includes sympathetically vibrating a vibratory means and rejecting vibrations outside a specified frequency range and outside a specified duration of vibration.

16. Safety joint apparatus for use in a drill string comprising:

(a) an upper tubular body having a threaded connection with a drill string portion thereabove and further having an axial passage therethrough communicated with the drill string to conduct drilling mud therethrough;

(b) a lower tubular body having a threaded connection with a drill string portion therebelow and further having an axial passage therethrough communicated with the drill string to conduct drilling mud therethrough;

(c) first threaded tubular surface means being defined within one of said upper or lower tubular bodies;

(d) second threaded tubular surface means being defined by the other of said upper and lower tubular bodies, said first and second threaded tubular surface means having mating threaded relation and further including:

(1) threads on one of said mating threaded surfaces formed of coacting helically arranged shoulders, one of said shoulders positioned at an angle to cooperatively receive in threaded engagement therewith the other of said mating threaded surfaces;

(2) wherein said one shoulder is set at an angle to permit the other of said mating threaded surfaces to be pulled free of one of said mating threaded surfaces;

(3) wherein the other of said mating threaded surfaces incorporates a plurality of lengthwise slots to define a set of individual concentrically arranged collet fingers permitting relative radial deflection of said fingers to enable the threads to threadedly engage the threads on the other of said mating threaded surfaces on rotation and to ride over the threads on axial pull to separate said first and second mating threaded surfaces;

(4) a locking sleeve located internally of one of said upper and lower tubular bodies, said locking sleeve securing said fingers in a radially determined relationship which prevents inward radial deflection thereof to maintain said first and second mating threaded surfaces in a threaded position preventing axial movement therebetween, said locking sleeve being formed internally to define a locking receptacle having shoulders at each extremity thereof, said locking sleeve being linearly movable to a releasing position permitting radially inward deflection of said collet fingers; and (d) hydraulically energized release tool means capable of being hydraulically transported through said drill string to said safety joint apparatus and having radially movable retainer pad means pivotally attached to said tool means for said radial movement and defining shoulders at each extremity thereof and cam means for urging said pad means radially outwardly into interlocked relation within said locking receptacle with the shoulders thereof in driving relation with said shoulders defined by said locking receptacle, said release tool means being linearly movable within said one of said upper and lower tubular bodies when in said interlocked relation with said locking sleeve thus selectively moving said locking sleeve linearly to said releasing position and from said releasing position to said locking position.

17. The apparatus of claim 16, including:

(a) frangible lock means releasably securing said locking sleeve in said position securing said fingers in said radially determined relationship; and (b) said lock means breaking upon movement of said locking sleeve by said release tool means upon movement of said release tool means to said releasing position.

18. The apparatus of claim 17, wherein:

said frangible lock means establishes a mechanical connection between said release element and at least one of said collet fingers, said release tool means causing breaking of said frangible lock means upon hydraulically energized downward shifting of said release element.

19. The apparatus of claim 18, wherein said frangible lock means comprises:

at least one shear bolt securing said release element in assembly with at least one of said fingers.

20. The apparatus of claim 16, wherein said locking sleeve comprises:

finger support means being defined by said sleeve element;

shear means interconnecting said finger support means in supporting assembly with said collet fingers; and said release tool causing shearing of said shear means and linear movement of said sleeve element to a position releasing said finger support means from said supporting assembly with said collet fingers.

21. The apparatus of claim 16, wherein:

(a) said locking sleeve defines a collet element which is disposed within said safety joint apparatus and defines said other of said mating threaded surface, said collet element defining second threaded surface means and being linearly movable relative to said body sections; and (b) collet retainer means movably positioned within one of said bodies and having threaded relation with said second threaded surface means and adjustably securing said collet in assembly with at least one of said upper and lower tubular bodies, said collet retainer means being rotatable within said one tubular body and imparting linear movement to said collet element when so rotated.

22. The apparatus of claim 21, including:

an assembly tool having a collet retainer actuating portion that is receivable in mating, non-rotatable relation with said collet retainer means, said collet retainer actuating portion of said assembly tool being insertable into one of said tubular bodies and being manipulatable externally of said safety joint apparatus to assemble said collet retainer means to said collet and to make up said threads of said mating threaded surfaces.

23. The apparatus of claim 22, wherein:

(a) spline means establish a torque transmitting non-rotatable relation between said upper and lower tubular bodies.

24. The apparatus of claim 16 wherein said upper and lower tubular bodies have a common external diameter and wherein one has an extending cylindrical outer skirt adapted to at least partially telescope over the other of said tubular bodies against a shoulder thereon cooperatively receiving said cylindrical skirt and wherein the axial passages within said upper and lower tubular bodies communicate axially with one another and have a common cross-sectional area.

25. The apparatus of claim 16 wherein each of said upper and lower tubular bodies supports concentric sleeves which telescope relative to one another and which are spaced from one another to define an annular cavity and wherein said first and second mating threaded surfaces are within said annular cavity and wherein one of said mating threaded surfaces is cut with a plurality of parallel, lengthwise slots to define collet fingers therein of dimensions enabling said collet fingers to flex radially.

* * * * *